US010071407B2

(12) United States Patent
Hwang et al.

(10) Patent No.: US 10,071,407 B2
(45) Date of Patent: Sep. 11, 2018

(54) APPARATUS FOR CONTROLLING CAMBER AND METHOD FOR SAME

(71) Applicant: Hyundai Steel Company, Incheon (KR)

(72) Inventors: Jin-Dong Hwang, Dangjin-si (KR); Hyeong-Jin Kim, Jeonju-si (KR); Yong-Kook Park, Anyang-si (KR); Woo-Young Shin, Gongju-si (KR)

(73) Assignee: Hyundai Steel Company, Dong-gu (KR)

( * ) Notice: Subject to any disclaimer, the term of this patent is extended or adjusted under 35 U.S.C. 154(b) by 606 days.

(21) Appl. No.: 14/780,510

(22) PCT Filed: Dec. 27, 2013

(86) PCT No.: PCT/KR2013/012334
§ 371 (c)(1),
(2) Date: Sep. 25, 2015

(87) PCT Pub. No.: WO2014/157816
PCT Pub. Date: Oct. 2, 2014

(65) Prior Publication Data

US 2016/0038984 A1 Feb. 11, 2016

(30) Foreign Application Priority Data

Mar. 28, 2013 (KR) ..... 10-2013-0033249

(51) Int. Cl.
*B21B 38/04* (2006.01)
*B21B 37/68* (2006.01)
(Continued)

(52) U.S. Cl.
CPC ..... *B21B 37/68* (2013.01); *B21B 37/28* (2013.01); *B21B 38/00* (2013.01); *B21B 38/04* (2013.01);
(Continued)

(58) Field of Classification Search
CPC ..... B21B 37/28; B21B 38/04; B21B 38/00; B21B 37/68; B21B 39/14; B21C 51/00; B21D 11/10
(Continued)

(56) References Cited

U.S. PATENT DOCUMENTS 4,139,890 A * 2/1979 Yerkes ..... B21B 38/04 700/145
4,255,954 A * 3/1981 Chabanov ..... B21B 37/28 72/10.3
(Continued)

FOREIGN PATENT DOCUMENTS

JP 03-230803 A 10/1991
JP 08-320215 12/1996
(Continued)

OTHER PUBLICATIONS

Japanese Office Action dated Nov. 1, 2016 by the Japanese Patent Office, in corresponding Japanese Patent Application No. 2016-505375.
(Continued)

*Primary Examiner* — David B Jones
(74) *Attorney, Agent, or Firm* — Locke Lord LLP; Daniel J. Fiorello

(57) ABSTRACT

Provided is a camber control apparatus and method capable of reducing camber of a slab sizing press (SSP). The camber control apparatus and method may calculates a camber amount through an imaging process and differently set zeroing of anvils at a work side and a drive side, thereby reducing camber. Thus, the camber control apparatus and method can reduce quality defects such as telescope, twist, wave, and roll mark, increase the lifetime of equipment by reducing a variation in load applied to the equipment, and minimize a cost caused by an equipment accident.

6 Claims, 4 Drawing Sheets

(51) Int. Cl.

| | |
|---|---|
| ***B21C 51/00*** | (2006.01) |
| ***B21B 37/28*** | (2006.01) |
| ***B21D 11/10*** | (2006.01) |
| ***B21B 38/00*** | (2006.01) |
| *B21B 39/14* | (2006.01) |

(52) U.S. Cl.
CPC ..... *B21C 51/00* (2013.01); *B21D 11/10* (2013.01); *B21B 39/14* (2013.01)

(58) Field of Classification Search
USPC ..... 72/12.7
See application file for complete search history.

(56) References Cited

U.S. PATENT DOCUMENTS 4,989,164 A * 1/1991 Desrousseaux ..... B21B 38/00 348/135
6,622,540 B2 * 9/2003 Jones ..... B21D 11/10 72/11.2
8,459,073 B2 * 6/2013 Isei ..... B21O 51/00 72/11.2

FOREIGN PATENT DOCUMENTS

| | | | |
|---|---|---|---|
| JP | 2004160530 | A | 6/2004 |
| JP | 2011218390 | A | 11/2011 |
| KR | 10-2000-0033981 | A | 6/2000 |
| KR | 10-2003-0053332 | A | 6/2003 |
| KR | 10-2010-0046998 | A | 5/2010 |
| KR | 1020100069826 | A | 6/2010 |
| KR | 10-2013-0002405 | A | 1/2013 |

OTHER PUBLICATIONS

International Search Report for PCT/KR2013/012334 dated Apr. 7, 2014.

* cited by examiner

APPARATUS FOR CONTROLLING CAMBER AND METHOD FOR SAME

CROSS-REFERENCE TO RELATED APPLICATIONS

This application is the national phase under 35 U.S.C. § 371 of PCT International Application No. PCT/KR2014/012334, filed Dec. 27, 2013, which claims benefit and priority of Korean Application No. 10-2013-0033249, filed Mar. 28, 2013; the entire contents of the aforementioned applications are hereby incorporated herein by reference.

TECHNICAL FIELD

The present invention relates to a camber control apparatus and method, and more particularly, a camber control apparatus and method capable of reducing camber of a slab sizing press (SSP).

BACKGROUND ART

In general, hot rolling includes a process of forming a product by rolling the product in a shape based on the standard. A half-finished product, such as a slab, extracted from a heating furnace is transferred to a rolling mill through a descaler, the rolling mill including upper and lower rolls for hot rolling. The rolling mill performs thickness rolling on the slab.

Then, width rolling is performed on the slab which has been rolled in the rolling mill.

The width rolling for the slab is to reduce the width of the slab by hitting a side surface of the slab through a slab sizing press (SSP) using an anvil.

The related art of the present invention is disclosed in Korean Patent Laid-open Publication No. 2003-0053332 published on Jun. 28, 2003.

DISCLOSURE

Technical Problem

Various embodiments of the present invention are directed to a camber control apparatus and method capable of reducing camber of an SSP.

Also, various embodiments of the present invention are directed to a camber control apparatus and method capable of reducing camber by calculating or determining a camber amount through an imaging process.

Also, various embodiments of the present invention are directed to a camber control apparatus and method capable of reducing camber by differently setting zeroing of anvils at a work side WS and a drive side DS.

Technical Solution

In an embodiment, a camber control apparatus may include: a vision imaging unit configured to take an image of the shape of a slab which is rolled in the widthwise direction; a vision image processing unit configured to process the taken image and measure feature information of the slab; a control unit configured to determine a camber amount and a direction in which camber occurred, using the measured information, select an anvil of which the position is to be adjusted, using the camber amount information and the direction in which the camber occurred, and calculate an adjusting value for adjusting the position of the anvil; and a driving motor configured to rotate a worm gear by a designated amount in a designated direction in response to the calculated adjusting value according to control of the control unit, the worm gear capable of adjusting the position of the selected anvil. The feature information may include one or more of the length, width, edges, vertexes, and longitudinal or widthwise center of the slab and a distance between the edges or the vertexes.

The camber control apparatus may further include a displacement sensor configured to measure the position of an anvil or a distance to the anvil and output the measured position or distance to the control unit, when the position of the anvil is adjusted or zeroing is performed.

The vision imaging unit may include one camera which takes an image of the entire length of the slab, a plurality of cameras, of which each takes a partial image of the slab at a predetermined interval in response to the length of the slab, or one camera which takes a partial image of the slab at each predetermined time interval in response to the advancing speed of the slab. When a plurality of images are taken for the slab, the vision image processing unit may connect the plurality of images to construct one image including the entire length of the slab.

In an embodiment, a camber control method may include: taking an image of the shape of a slab which is rolled in the widthwise direction; measuring feature information of the slab from the taken image; determining a camber amount and a direction in which camber occurred, using the measured information; selecting an anvil of which the position is to be adjusted, using the camber amount information and the direction in which the camber occurred, and calculating an adjusting value for adjusting the position of the anvil; and rotating a worm gear by a designated amount in a designated direction in response to the calculated adjusting value, the worm gear capable of adjusting the position of the selected anvil. The feature information may include one or more of the length, width, edges, vertexes, and longitudinal or widthwise center of the slab and a distance between the edges or the vertexes.

The rotating of the worm gear may include advancing or retreating the anvil by controlling the rotation direction of the worm gear, and adjusting an advance distance or retreat distance of the anvil by controlling the rotation amount or rotation angle of the worm gear.

The rotating of the worm gear may include automatically controlling the rotation direction and the rotation amount or the rotation angle of the worm gear using a driving motor.

Advantageous Effects

According to the embodiments of the invention, the camber control apparatus and method serves to reduce camber of an SSP. The camber control apparatus and method may calculates a camber amount through an imaging process and differently set zeroing of the anvils at the work side WS and the drive side DS, thereby reducing camber. Thus, the camber control apparatus and method can reduce quality defects such as telescope, twist, wave, and roll mark, increase the lifetime of equipment by reducing a variation in load applied to the equipment, and minimize a cost caused by an equipment accident.

DESCRIPTION OF DRAWINGS

The above and other aspects, features and advantages of the invention will become apparent from the following detailed description in conjunction with the accompanying drawings, in which.

BEST MODE

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
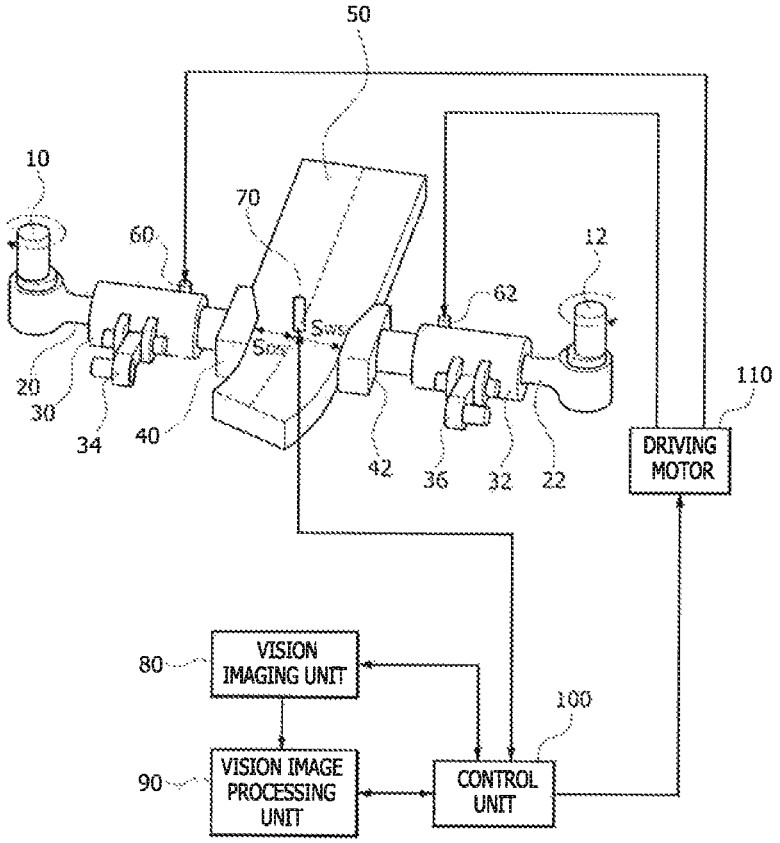
FIG. 1 is a block diagram illustrating a schematic configuration of a camber control apparatus for reducing camber of an SSP in accordance with an embodiment of the present invention.

FIG. 1 is a block diagram illustrating a schematic configuration of a camber control apparatus for reducing camber of a slab sizing press (SSP) in accordance with an embodiment of the present invention.

As illustrated in FIG. 1, the SSP to which the present invention is applied includes crankshafts 10 and 12 for transmitting a crank motion, a plurality of connection units 20, 30, 22, 32, 34, and 36 connected to the crankshafts, and anvils 40 and 42 for hitting a slab 50 at both sides WS and DS in connection with the connection units.

The connection units 20, 30, 22, 32, 34, and 36 include connecting rods 20 and 22 for transmitting crank motions of the crankshafts 10 and 12, sliders 30 and 32 interlocked to the connecting rods 20 and 22, and synchronization units 34 and 36 for supporting and synchronizing the sliders.

The above-described structure is symmetrically formed to adjust the width of the slab 50 inserted between the anvils 40 and 42. That is, when the SSP transmits rocking motions caused by rotations of the crankshafts 10 and 12 to the outer anvils 40 and 42, the width of the slab 50 is reduced by the left and right anvils 40 and 42 placed against both side surfaces of the slab 50. As such, the SSP transmits mechanical power to the crankshafts 10 and 12 using a hydraulic motor, and finally drives the anvils 40 and 42 through the connection units 20, 30, 22, 32, 34, and 36.

The operation of the anvils 40 and 42 forms a circular path in such a direction that the anvils 40 and 42 hit and roll the slab 50 and then push the rolled slab 50.

Since the configuration of the SSP is publicly known, the detailed descriptions thereof are omitted herein.

The camber control apparatus for controlling camber of the SSP in accordance with the embodiment of the present invention includes units which can take an image of the slab 50 to measure the direction and amount of camber and differently set zeroing for both sides WS and DS of the anvils.

The camber control apparatus includes a displacement sensor 70, a vision imaging unit 80, a vision image processing unit 90, a control unit 100, and a driving motor 110.

The displacement sensor 70 measures distances $S_{WS}$ and $S_{DS}$ between the displacement sensor 70 and the anvils 40 and 42 at both sides of the zero position of the SSP in the widthwise direction thereof. When the initial positions of the anvils 40 and 42 were accurately set, the distances $S_{WS}$ and $S_{DS}$ to the anvils 40 and 42 from the displacement sensor 70 in the center of the anvils 40 and 42 may be measured at the same value.

Furthermore, it is desirable that the displacement sensor 70 is installed in the center, if possible. However, it is not easy to physically install the displacement sensor 70 in the precise center. Thus, it is likely that the displacement sensor 70 is installed to slightly lean to any one side of the center. Therefore, the measured distances SWS and SDS from the displacement sensor 70 to the anvils 40 and 42 may differ from each other, and the zero position between the anvils may be set through a zeroing process for the anvils. That is, the zeroing process is to equalize the actual distances to the anvils 40 and 42 from the zero position. The zero position does not correspond to the position where the displacement sensor is installed.

The displacement sensor 70 may detect a hitting start position and a hitting end position of the anvils 40 and 42 which hit the slab 50 at both sides. The hitting start position and the hitting end position of the anvils 40 and 42 may be detected in a state where the slab 50 is not inserted, or detected in a state where the slab 50 is inserted. That is, the distances to the anvils may be measured in a state where the slab is not inserted, in order to set up the anvils 40 and 42, or measured in a state where the slab is inserted, in order to determine the operation states of the anvils.

The displacement sensor 70 may continuously measure the distances to the anvils 40 and 42 in real time and output the measured distances to the control unit 100. Alternatively, according to a command of the control unit 100, the displacement sensor 70 may measure the distances to the anvils only at a desired point of time and output the measured distances.

The displacement sensor 70 may measure distances or positions using changes in capacitance, inductance, electrical resistance, or generated electromotive force. Alternatively, the displacement sensor 70 may irradiate light (for example, laser or infrared light) onto the target or an anvil, receive light reflecting from the anvil, and measure distances depending on at which position of a light receiving element light is formed. For example, the light receiving element includes a CCD (Charge Coupled Device) and a PSD (Position Sensitive Detector). In particular, the CCD-type displacement sensor outputs the value of the position at which the strongest light is formed in the CCD, as a distance value. Thus, the CCD-type displacement sensor is not significantly influenced by color and external light.

The displacement sensor 70 may further include a cooling and sealing unit, in order to guarantee a stable operation. The cooling and sealing unit may prevent the influence of temperature, external temperature, and steam such that a normal operation can be performed. Furthermore, when the distance to an anvil is measured, it is desirable to measure the distance to the hitting surface of the anvil. However, when it is difficult to measure the distance to the hitting surface of the anvil due to the structure of press equipment, the anvil may be partially modified to add a strike serving as a measuring body of the displacement sensor 70 (for example, a light reflecting unit).

The vision imaging unit 80 takes an image of the shape of the slab 50 which is rolled in the widthwise direction.

Figure 2:
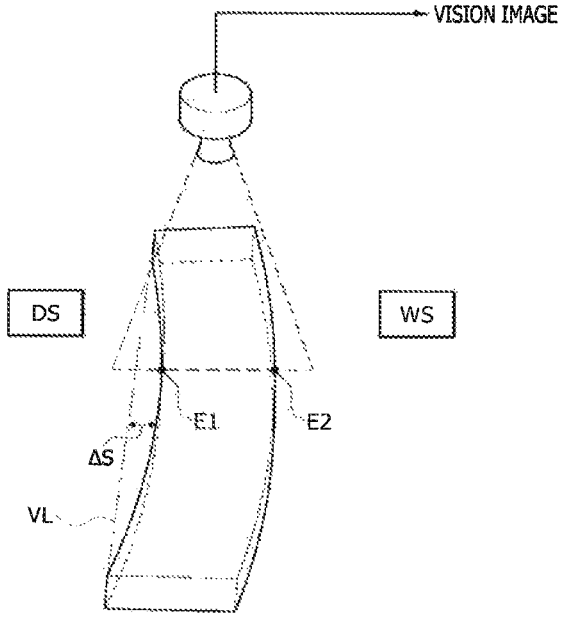
FIG. 2 is a diagram illustrating a method for detecting a camber direction and a camber amount in accordance with the embodiment of the present invention.

Referring to FIG. 2, the vision imaging unit 80 takes an image of the slab 50 which is rolled in the widthwise direction, from the top. At this time, the vision imaging unit 80 takes an image of the shape of the slab 50 or thermal energy or thermal infrared rays emitted from the slab 50, using a CCD element, camera, or heat-detecting camera.

At this time, it is desirable that the vision imaging unit 80 takes an image of the slab 50 such that the entire length from the leading end to the rear end of the slab 50 is included in the image. If not possible, however, the vision imaging unit 80 may selectively take an image of only a specific portion in the entire length of the slab.

For example, the vision imaging unit 80 may take an image of only the leading or rear end portion of the slab or only the central portion of the entire length of the slab. Alternatively, when a specific event occurs during the width rolling, the vision imaging unit 80 may take an image of only the corresponding portion. For example, the event may include a situation in which the distances to the anvils, detected by the displacement sensor 70, are different from each other or a situation in which a command is generated by the control unit 100 or a driver.

Thus, the vision imaging unit 80 may include one or more imaging elements (for example, CCD or CMOS) or cameras which are consecutively arranged at a predetermined interval according to the length of the slab, in order to take an image of the entire length of the slab 50, the interval corresponding to the imaging range of the imaging elements or cameras. Alternatively, the vision imaging unit 80 may successively take images at a predetermined time interval according to the advancing speed of the slab 50 using one imaging element, the predetermined time interval corresponding to a time interval at which the vision imaging unit 80 can take an image at an interval corresponding to the imaging range of the imaging element or camera.

The imaging interval (for imaging time interval) may be controlled by the control unit 100.

The vision image processing unit 90 serves to process the image taken by the vision imaging unit 80. When a plurality of images are taken for the slab, the vision image processing unit 90 connects the plurality of images and constructs one image including the entire length of the slab.

The vision image processing unit 90 measures the length, width (distance between E1 and E2), edges, vertexes, longitudinal or widthwise center of the slab or a distance between the edges or vertexes.

The vision image processing unit 90 may draw a virtual line VL connecting the vertexes of the leading end and the rear end of the slab in the longitudinal direction thereof, and measure a distance ΔS from the center of the virtual line VL to the closest edge in the perpendicular direction. At this time, the distance ΔS from the center of the virtual line VL to the closest edge in the perpendicular direction is referred to as a camber amount.

The virtual line VL may be drawn at a convex or concave surface between both side surfaces WS and DS of the slab 50 according to the direction or shape in which camber occurred.

At this time, a camber amount measured at the convex surface and a camber amount measured at the concave surface do not precisely coincide with each other, but a large difference does not occur therebetween. Thus, in the present embodiment, although only a camber amount of any one side surface WS or DS is measured, the camber amount may be used for camber control.

Furthermore, according to whether the edges are positioned only at one side surface with respect to the virtual line VL (for example, the left or right side of the virtual line VL) or divided and positioned at both side surfaces around the virtual line VL, the vision image processing unit 90 may determine whether the virtual line VL is drawn at the concave surface or the convex surface. In other words, the image processing unit 90 may determine the direction or shape that the camber occurred, or determine whether the shape is convex toward the work side WS and concave toward the drive side DS, or whether the shape is concave toward the work side WS and convex toward the drive side DS.

In the present embodiment, suppose that camber occurred in the concave direction.

For example, when the shape is convex toward the work side WS and concave toward the drive side DS, it may indicate that camber occurred toward the drive side DS, and when the shape is concave toward the work side WS and the convex toward the drive side DS, it may indicate that camber occurred toward the work side WS.

Then, the control unit 100 may determine the camber amount and the shape or direction in which the camber occurred, using the information measured by the vision image processing unit 90. The information may include the length, width, edges, vertexes, longitudinal or widthwise center of the slab or a distance between the edges or vertexes.

Then, the control unit 100 controls the camber according to the camber direction and the camber amount.

That is, the control unit 100 controls the anvils to reduce the camber amount.

In other words, the camber may occur due to a difference between the distances SWS and SDS to the anvils 40 and 42 from the zero position. The difference may be caused by abrasion of the anvils or wrong setup after the anvils are replaced. That is, an anvil close to the center (for example, the anvil 40) tends to first hit the slab, and the other anvil remote from the center (for example, the anvil 42) tends to later hit the slab 50. When an anvil at any one side surface WS or DS first hits the slab due to the difference in distance to the center between the anvils, camber occurs in the corresponding direction.

Figure 3:
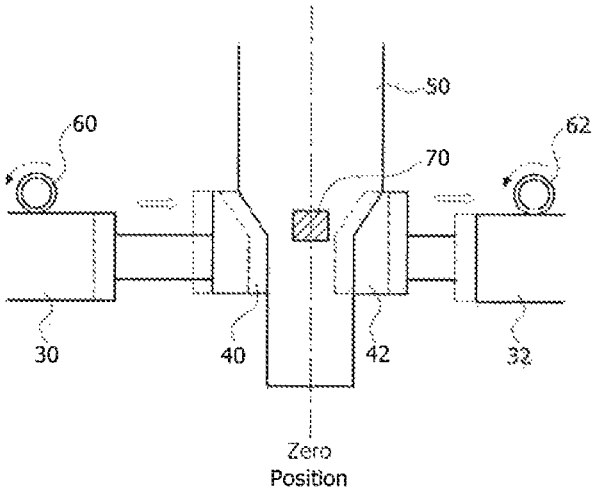
FIG. 3 is a diagram illustrating a method for adjusting the position of an anvil using the camber control apparatus in accordance with the embodiment of the present invention.

Thus, as illustrated in FIG. 3, the control unit 100 adjusts the positions of the anvils in the direction to reduce a camber amount when camber occurs. That is, the control unit 100 advances or retreats the anvil at any one side surface WS or DS in the hitting direction.

The advance and retreat of the anvils 40 and 42 may be controlled through the rotation direction of worm gears 60 and 62 connected to the sliders 30 and 32, and the advance distance and retreat distance may be adjusted by the rotation amount (or rotation angle) of the worm gears 60 and 62.

At this time, only the anvil positioned in the direction that the camber occurred may be adjusted, only the other anvil positioned in the opposite direction of the direction that the camber occurred may be adjusted, or both of the anvils may be adjusted. When both of the anvils need to be adjusted, an anvil at one side surface (for example, the anvil 40) may be first adjusted, and the other anvil at the other side surface (for example, the anvil 42) may be then adjusted after the occurrence state of the camber is checked, or both of the anvils 40 and 42 may be adjusted at the same time.

As described above, the control unit 100 determines the camber amount and the shape or direction that the camber occurred (for example, WS or DS direction), selects an anvil of which the position is to be adjusted, using the direction information and the camber amount information, and calculates an adjusting value.

In the present embodiment, suppose that the position of the anvil positioned in the direction that camber occurred is adjusted, for convenience of description.

The control unit 100 can calculate the adjusting value using an adjusting value based on camber amounts accumulated during width rolling. That is, whenever width rolling is performed, the camber amount is measured. The directions and adjusting values of the anvils which are adjusted to reduce the camber are stored in the form of a database or lookup table, and an adjusting value corresponding to a detected camber amount is calculated from the database or lookup table. Thus, the camber control apparatus in accordance with the embodiment of the present invention may further include a storage unit (not illustrated) for storing the database or the lookup table.

When the anvil of which the position is to be adjusted is determined and the adjusting value is calculated, the control unit 100 may control the driving motor 110 to drive the worm gear 60 or 62 corresponding to the anvil. That is, the control unit 100 determines the rotation direction and rotation amount (or rotation distance or rotation angle) of the worm gear 60 or 62 according to the calculated adjusting value. For example, when supposing that the position of the anvil (for example, the anvil 40) at the side surface where the camber occurred is adjusted, the control unit 100 drives the corresponding worm gear 60 in response to the calculated adjusting value.

When the driving motor 110 is used to drive the worm gears 60 and 62, the control unit 100 may monitor the positions (or adjusted distances) of the anvils 40 and 42 through the displacement sensor 70 in real time, and output the monitored positions through a monitor (or operating program) such that a driver can recognize the positions. The adjusted distances may be accumulated and utilized for calculating an adjusting value when the camber is adjusted during the next process.

In the present embodiment, the functions of the vision image processing unit 90 and the control unit 100 have been separately described. According to the configuration of the apparatus, however, the control unit 100 may include the function of the vision image processing unit 90.

Hereafter, a camber control method using the camber control apparatus will be described.

Figure 4:
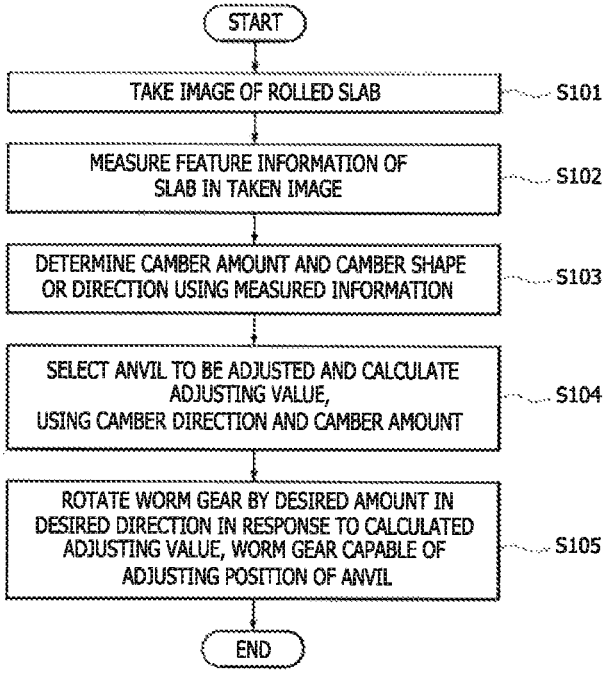
FIG. 4 is a flowchart for describing a camber control method in accordance with an embodiment of the present invention.

FIG. 4 is a flowchart for describing a camber control method in accordance with an embodiment of the present invention.

Referring to FIG. 4, the control unit 100 takes an image of the slab 50 which is rolled in the widthwise direction, at step S101. At this time, the shape of the slab may include an image of thermal energy or thermal infrared rays emitted from the slab.

Then, in order to detect a camber occurrence direction and a camber amount from the image of the slab, the control unit 100 measures feature information of the slab (for example, the length, width, edges, vertexes, or longitudinal or widthwise center of the slab, or a distance between the edges or the vertexes), at step S102.

Using the measured information, the control unit 100 determines the camber amount and the shape or direction that the camber occurred, at step S103. For example, the control unit 100 determines whether the slab is concavely bent toward the work side WS or concavely bent toward the drive side DS, draws a virtual line VL connecting the vertexes of the leading end and the rear end of the slab in the direction that the slab is bent, measures a distance ΔS from the center of the virtual line VL to the closest edge in the perpendicular direction, and determines the measured distance as the camber amount.

At this time, the method for measuring the camber amount is only an example for promoting understanding. Thus, the present invention is not limited thereto.

The control unit 100 determines or selects an anvil of which the position is to be adjusted, using the camber amount information and the direction information in which the camber occurred, and calculates an adjusting value for adjusting the position of the anvil, at step S104.

The anvil of which the position is to be adjusted may include an anvil positioned in the direction that the camber occurred, the other anvil positioned in the opposite direction of the direction that the camber occurred, or both of the anvils. In the present embodiment, suppose that the position of the anvil in the direction that the camber occurred is adjusted, for convenience of description.

The control unit 100 may calculate an adjusting value corresponding to the camber amount detected during the current hot rolling, using adjusting values based on camber amounts which have been accumulated in the form of a database or lookup table during previous width rolling operations.

When the anvil of which the position is to be adjusted is determined and the adjusting value is calculated, the control unit 100 rotates the corresponding worm gear 60 or 62 capable of adjusting the position of the anvil, at step S105. At this time, the worm gear 60 or 62 is rotated by a designated amount (or specific angle) in a designated direction (for example, the clockwise or counterclockwise direction) in response to the calculated adjusting value.

That is, the control unit 100 advances or retreats the selected anvil in the hitting direction according to the rotation direction of the worm gear 60 or 62, and adjusts the advance distance or retreat distance of the anvil according to the rotation amount of the worm gear. At this time, the worm gear 60 or 62 can be conveniently and precisely controlled through the driving motor 110.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

What is claimed is:

1. A camber control apparatus comprising:

a vision imaging unit, the vision imaging unit taking an image of a shape of a slab which is rolled in a widthwise direction;

a vision image processing unit processing the image and measuring feature information of the slab from the image;

a control unit determining a camber amount and a direction in which a camber occurred using the measured feature information, and selecting an anvil of which the position is to be adjusted, using the camber amount and the direction in which the camber occurred, and calculating an adjusting value for adjusting the position of the anvil; and a driving motor rotating a worm gear by a designated amount in a designated direction in response to the adjusting value, the worm gear adjusting the position of the selected anvil, wherein the feature information includes one or more of a length, a width, edges, vertexes, and at least one of a longitudinal center and a widthwise center of the slab and a distance between the edges or the vertexes.

2. The camber control apparatus of claim 1, further comprising a displacement sensor measuring at least one of the position of an anvil and a distance to the anvil from the sensor, and outputting at least one of the measured position and distance to the control unit, when the position of the anvil is adjusted or zeroing is performed.

3. The camber control apparatus of claim 1, wherein the vision imaging unit comprises one of one camera which takes an image of the entire length of the slab, a plurality of cameras of which each takes a partial image of the slab at a predetermined interval in response to the length of the slab, and one camera which takes a partial image of the slab at each predetermined time interval in response to the advancing speed of the slab, and when a plurality of images are taken of the slab, the vision image processing unit connects the plurality of images to construct one image including the entire length of the slab.

4. A camber control method comprising:

taking an image of the shape of a slab which is rolled in a widthwise direction;

measuring feature information of the slab from the image;

determining a camber amount and a direction in which a camber occurred, using the feature information;

selecting an anvil of which the position is to be adjusted, using the camber amount and the direction in which the camber occurred, and calculating an adjusting value for adjusting the position of the anvil; and rotating a worm gear by a designated amount in a designated direction in response to the adjusting value, the worm gear adjusting the position of the selected anvil, wherein the feature information includes one or more of a length, a width, an edges, a vertexes, and a longitudinal center or widthwise center of the slab and a distance between at least one of the edges and the vertexes.

5. The camber control method of claim 4, further comprising advancing and retreating the anvil by controlling the rotation direction of the worm gear, and adjusting an advance distance and a retreat distance of the anvil by controlling the rotation amount or rotation angle of the worm gear.

6. The camber control method of claim 4, further comprising automatically controlling the rotation direction and the rotation amount or the rotation angle of the worm gear using a driving motor.

* * * * *